US008770444B2

(12) United States Patent
Rossignol et al.

(10) Patent No.: US 8,770,444 B2
(45) Date of Patent: Jul. 8, 2014

(54) FLUID MATERIAL DISPENSING KIT INCLUDING A POUCH AND A DISPENSING CASE

(71) Applicants: Eric Rossignol, Chalon sur Saone (FR); Pierre Dumont, Incheville (FR)

(72) Inventors: Eric Rossignol, Chalon sur Saone (FR); Pierre Dumont, Incheville (FR)

(73) Assignee: Rexam Dispensing SMT S.A.S. (FR)

( * ) Notice: Subject to any disclaimer, the term of this patent is extended or adjusted under 35 U.S.C. 154(b) by 0 days.

(21) Appl. No.: 13/682,432

(22) Filed: Nov. 20, 2012

(65) Prior Publication Data

US 2013/0075423 A1 Mar. 28, 2013

Related U.S. Application Data

(63) Continuation of application No. PCT/FR2011/051055, filed on May 11, 2011.

(30) Foreign Application Priority Data

May 20, 2010 (FR) ..... 10 02142

(51) Int. Cl.
*B65D 37/00* (2006.01)
*B05B 11/00* (2006.01)
*B67B 7/86* (2006.01)

(52) U.S. Cl.
CPC ..... *B05B 11/3028* (2013.01); *B05B 11/3036* (2013.01); *B67B 7/28* (2013.01)
USPC ..... 222/207; 222/105; 222/82

(58) Field of Classification Search
CPC ..... B05B 11/3028; B05B 11/3032; B05B 11/3033; B05B 11/3036; B67B 7/28; B67B 7/26
USPC ..... 222/100, 207, 105–107, 80–83, 209, 222/212–215; 206/581, 823
See application file for complete search history.

(56) References Cited

U.S. PATENT DOCUMENTS 5,454,488 A * 10/1995 Geier ..... 222/95
5,553,748 A 9/1996 Battle (Continued)

FOREIGN PATENT DOCUMENTS

EP 0447687 A1 9/1991
FR 2590809 A1 6/1987

(Continued)

OTHER PUBLICATIONS

International Search Report Application No. PCT/FR2011/051055 Completed: Jul. 7, 2011 Mailing Date: Aug. 2, 2011 2 pages.

*Primary Examiner* — Lien Ngo
(74) *Attorney, Agent, or Firm* — St. Onge Steward Johnston & Reens LLC

(57) ABSTRACT

A fluid material dispensing kit including a pouch, provided with a flexible casing and a dispensing case provided with a cover that is to be mounted onto a base. The cover includes an upper recess that has a manually flexibly deformable wall mounted thereon. The wall has a dispensing opening, and the cover is provided with a lower reinforcement that defines, with the wall, a pumping chamber. The reinforcement has a supply opening. The distribution opening and supply opening are provided with, respectively, an output valve and an input valve. The pouch has, built therein, a coupling provided with a well that is sealably covered by the casing of the pouch, and the reinforcement includes a nipple that is to be placed into the well. The nipple is set up so as to enable the perforation of the casing during the placement thereof into the well.

18 Claims, 3 Drawing Sheets

(56) References Cited

U.S. PATENT DOCUMENTS

| | | | | |
|---|---|---|---|---|
| 5,875,936 | A * | 3/1999 | Turbett et al. | 222/207 |
| 6,802,436 | B2 * | 10/2004 | Drennow et al. | 222/82 |
| 8,205,771 | B2 * | 6/2012 | Compton | 222/105 |
| 2007/0262091 | A1 | 11/2007 | Harper | |

FOREIGN PATENT DOCUMENTS

| | | | |
|---|---|---|---|
| FR | 2869771 | A1 | 11/2005 |
| WO | 2008138618 | A2 | 11/2008 |
| WO | 2009112660 | A1 | 9/2009 |

* cited by examiner

FLUID MATERIAL DISPENSING KIT INCLUDING A POUCH AND A DISPENSING CASE

FIELD OF THE INVENTION

The invention relates to a fluid material dispensing kit including a pouch wherein a product is conditioned and a dispensing case for said conditioned product, as well as a dispensing system obtained by assembling such a kit. In particular, the fluid material to be dispensed can be a liquid or a cream, in particular for cosmetic or pharmaceutical use.

BACKGROUND OF THE INVENTION

Systems are known comprising a pump mounted on a flexible conditioning pouch in order to provide the dispensing of the conditioned product by actuation of said pump.

In particular, the pump can include a pumping chamber which is flexibly deformable via pressing manually thereon. As such, pressing on the chamber induces a pressurization of the product for the dispensing thereof from said chamber and the vacuum induced by releasing said pressing enables the filling of said chamber. Such dispensing systems are for example known in FR-2 869 771, US-2007/0262091 or WO-2009/112660.

However, such dispensing systems are difficult to use in that the mounting of the pump on the flexible pouch is not satisfactory, in particular due to the fact that the pouch must be opened in order to carry out said mounting. Indeed, this results in a risk of leakage and/or contamination of the conditioned product.

Furthermore, in order to provide optimal operation of the pump, in particular concerning its priming speed, the product has to be conditioned without air in the pouch, which cannot be carried out easily during the mounting of the pump on the pouch of known dispensing systems.

In addition, the filling of the pouch of such dispensing systems must be carried out after the mounting of the pump on the pouch, therefore often resumed on a distant station, which is slow and expensive.

SUMMARY OF THE INVENTION

The invention aims to perfect prior art by proposing a dispensing kit which can be assembled in a particularly simple and reliable manner in order to obtain a dispensing system wherein a product can be conditioned at high speed in particular in the absence of contaminants and air.

To this effect, and according to a first aspect, the invention proposes a fluid material dispensing kit including a pouch provided with a flexible casing wherein said product is sealably conditioned, said kit comprising a dispensing case which is provided with a cover that is to be mounted onto a base in order to define between them a space wherein the pouch is intended to be housed, said cover comprising an upper recess which has a manually flexibly deformable wall mounted thereon, said wall having a dispensing opening for the product and said cover being provided with a lower frame defining with the wall a pumping chamber which is in communication with the dispensing opening, said frame having a supply opening for the product of the pumping chamber, with the dispensing and supply openings provided with, respectively, an output valve and an input valve which are set up in order to allow, via deformation of the pumping chamber, the dispensing of the product by the dispensing opening and, via elastic return, the supply of the pumping chamber by the supply opening, with the pouch incorporating a coupling provided with a well in communication with the conditioned product, said well being sealably covered by the casing of the pouch and said frame comprising a nipple that is to be placed into the well in order to place the supply opening in sealed communication with the conditioned product, said nipple being set up in order to enable the perforation of the casing during the placement thereof into the well.

According to a second aspect, the invention proposes a dispensing system obtained by assembling such a kit, wherein the cover is mounted on the base with the pouch housed in the space defined between them, with the nipple being placed into the well in order to place the supply opening in sealed communication with the product conditioned in said pouch.

BRIEF DESCRIPTION OF THE DRAWINGS

Other purposes and advantages of the invention shall appear in the following description, provided in reference to the annexed figures, wherein.

DETAILED DESCRIPTION OF THE INVENTION

Figure 1:
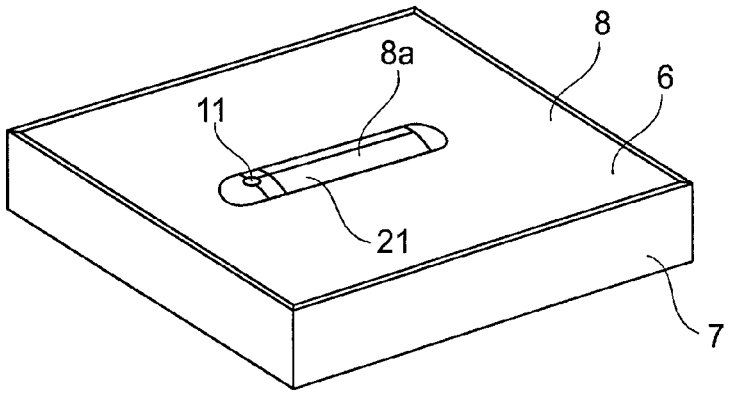
FIG. 1 shows in perspective a dispensing system according to an embodiment of the invention.
Figure 2:
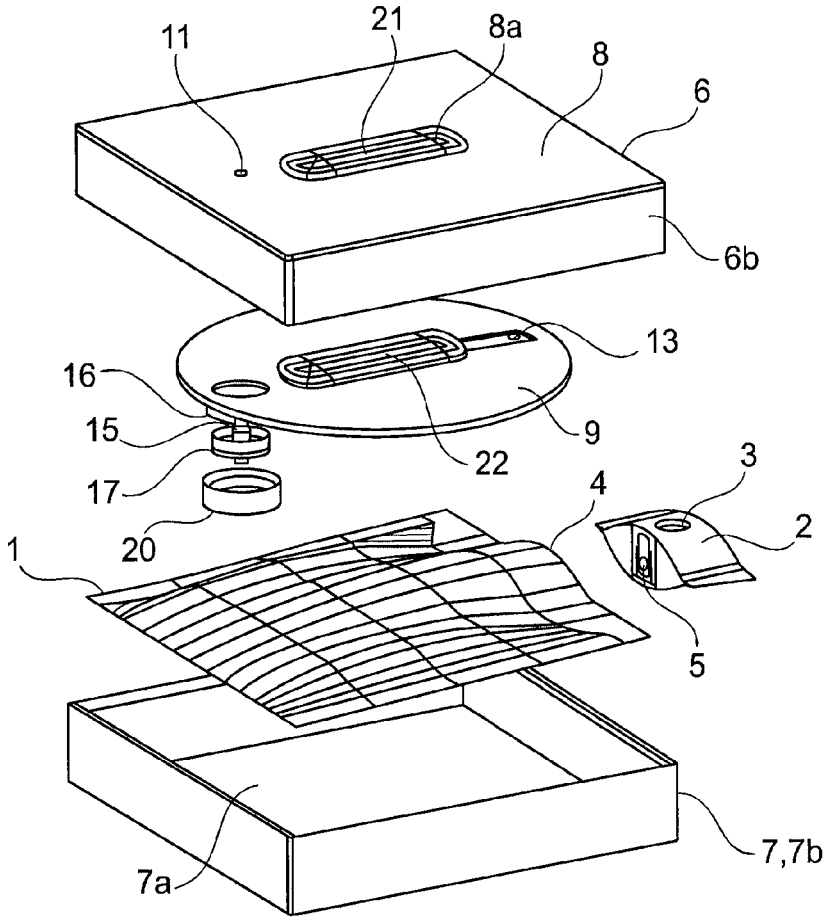
FIG. 2 shows an exploded view of the various components of the kit forming a dispensing system according to an embodiment of the invention.
Figure 3A:
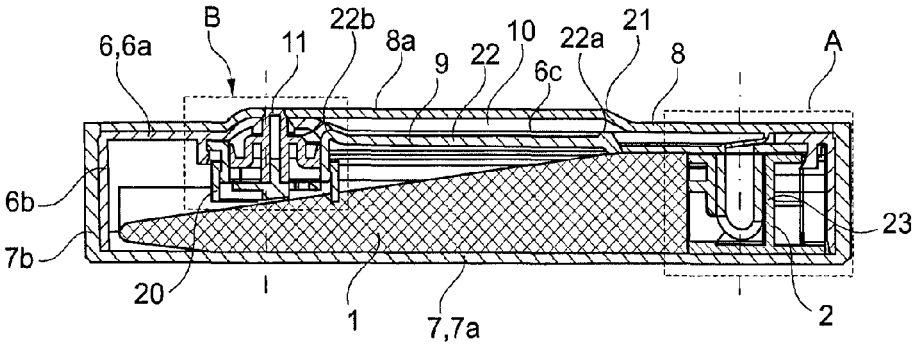
FIGS. 3*a*-3*b* show respectively a longitudinal cross-section and a transverse cross-section of the dispensing system according to FIG. 1.
Figure 3B:
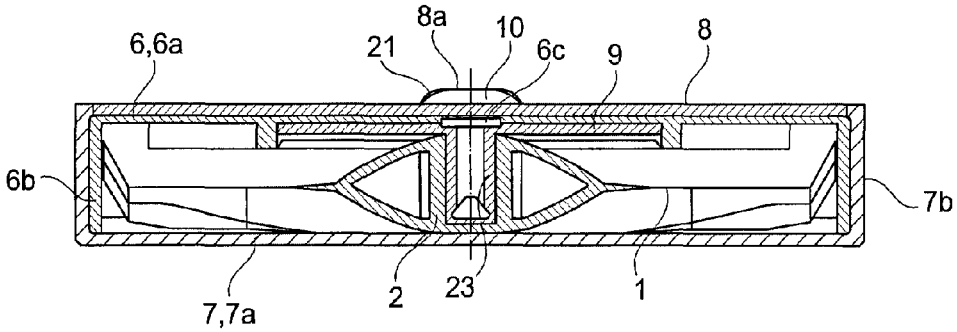
Figure 4A:
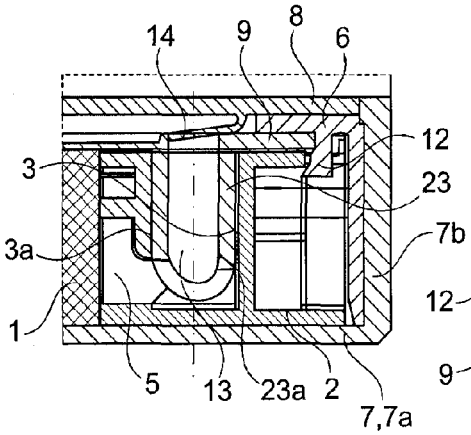
FIGS. 4*a*-4*b* are enlargements of the zones A (FIG. 4*a*) and B (FIG. 4*b*) in FIG. 3*a*.
Figure 4B:
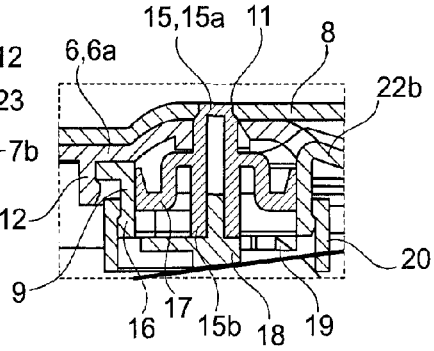

In the description, the terms of positioning in space are taken in reference to the position of use of the dispensing system shown in FIG. 1.

In relation with the figures, a system intended to contain a fluid material for the purposes of the dispensing thereof is described hereinbelow. In particular examples, the product can be a liquid or a cream, in particular for cosmetic or pharmaceutical use.

The system is obtained by assembling a dispensing kit comprising a pouch 1 provided with a flexible casing wherein the product is sealably conditioned and a dispensing case for said conditioned product. In particular, the case enables the pumping without air intake of the conditioned product, that is to say, during dispensing, air does not enter into the pouch 1 in compensation for the dispensed product, and the flexibility of the casing enables the decrease in the conditioning volume as the product is dispensed.

The pouch incorporates a coupling 2, for example made via molding of a plastic material, which is provided with a well 3 in communication with the conditioned product. In the embodiment shown, the pouch 1 has a mouth 4 formed between an upper edge and a lower edge of the casing, the coupling 2 have a curved upper surface and a lower surface whereon respectively an edge is fixed. Furthermore, the well 3 opens into the upper surface and the coupling 2 has a duct 5 which opens on either side into said well and into the pouch 1.

In this embodiment, the product is placed into the pouch 1 by the intermediary of the mouth 4, then the coupling 2 is arranged in said mouth in order to be fixed, for example by welding, between the upper and lower edges. As such, the product can easily be conditioned in the pouch 1, and this in particular under a controlled atmosphere, for example neutral with nitrogen, or without the presence of air inside said pouch, for example via vacuum packing. In addition, the conditioning can be carried out on conventional high-speed machines which condition the product then fix the coupling 2.

Furthermore, the upper edge comes to sealably cover the well 3 in such a way as to obtain a hermetic pouch 1 which can be stored and transported before the mounting thereof in the dispensing case.

The dispensing case is provided with a cover 6 that is to be mounted onto a base 7 in order to define between them a space wherein the pouch 1 is intended to be housed. According to an embodiment, the case can then be mounted in a packaging in order to complete the aesthetic appeal thereof.

In the figures, the cover 6 and the base 7 each have a wall 6*a*, 7*a* respectively upper and lower, said walls being bordered by a skirt 6*b*, 7*b*, the lower skirt 6*b* of the cover 6 coming into the upper skirt 7*b* of the base 7 in order to provide the mounting of said cover in said base.

The upper wall 6*a* of the cover 6 comprises a recess 6*c* which has a manually flexibly deformable wall 8 mounted thereon. In the embodiment shown, the flexibly deformable wall 8 is associated over the entire upper surface of the wall 6*a* of the cover 6. In particular, the flexibly deformable wall 8 can be made of a material of the polyolefin type with shape memory or of an elastomeric material.

The cover 6 is also provided with a rigid lower frame 9 which defines, with the flexibly deformable wall 8, a pumping chamber 10 which is in communication with a dispensing opening 11 formed in said wall. As such, the pumping chamber 10 is made through the recess 6*c* while being defined at the top by the deformable wall 8 and at the lower portion by the rigid frame 9.

In particular, the frame 9 can be carried out by molding of a rigid plastic material, for example as a part separate from the cover 6 which is associated with the lower surface of the wall 6*a* of said cover. In the embodiment shown, the frame 9 has the geometry of a disc, with the lower surface of the cover 6 having a sealed edge 12 which can be snap-fit of said frame against said lower surface.

The frame 9 also has a supply opening 13 for the product of the pumping chamber 10, the dispensing opening 11 and supply opening 13 being provided, respectively, with an output valve and an input valve which are set up so as to enable, via deformation of the pumping chamber 10, the dispensing of the product via the dispensing opening 11 and, via elastic return, the supply of the pumping chamber 10 via the supply opening 13.

In particular, the deformation of the pumping chamber 10 induces a pressurization of the product contained in said chamber, said pressure causing the closing of the input valve and the opening of the output valve, with the suction induced by the elastic return of the pumping chamber 10 to the non-deformed state causing the opening of the input valve and the closing of the output valve.

In the embodiment shown, the input valve is formed of a flexible lip 14 which is arranged in order to be thrust against the supply opening 13 during the deformation of the pumping chamber 10. In particular, the lip 14 is incorporated under the flexibly deformable wall 8, said lip being inclined toward the pumping chamber 10 pressing against the supply opening 13. The lip 14 has an upper thrusting surface via the pressurization of the product in the pumping chamber 10 and can be raised by the supply opening 13 through suction of the product conditioned in the pouch 1.

Moreover, the output valve comprises a needle 15 for closing off the dispensing opening 11, said needle able to be displaced reversibly during the deformation of the pumping chamber 10. In particular, the frame 9 has a seat 16 wherein the needle 15 is sealably mounted in translation by the intermediary of a means of elastic return, said needle comprising a collar 17 which is in communication with the pumping chamber 10 in such a way that the pressure exerted on the product during the deformation of said chamber induces the displacement of said needle outside of the dispensing opening 11.

In the figures, the means of elastic return comprise a pin 18 mounted on elastic lugs 19 which are formed in the lower opening of a ring 20, said ring being mounted on the seat 16 of the frame 9. Furthermore, the needle 15 has an upper end 15*a* for closing off the dispensing opening 11 and a lower end 15*b* pressing on the pin 18.

Moreover, the pouch 1 has a decreasing thickness from the coupling 2 towards the base in such a way as to enable the housing of the ring 20 in the case above the vicinity of said base. Alternatively, the ring 20 can be pressing against the pouch 1 in such a way, through the pressurization of the product in said pouch, as to favour the dispensing of said product.

In the embodiment shown, the flexibly deformable wall 8 has an upper zone 8*a* for pressing on the pumping chamber 10, said pressing being in particular carried out vertically in order to displace said zone in contact on the frame 9. More precisely, the flexibly deformable wall 8 has a bead 21 protruding from the upper surface of the cover 6, with the pressing zone 8*a* being formed on said bead and the pumping chamber 10 being formed inside said bead.

Advantageously, the pressing zone 8*a* has an extended geometry which is bordered on either side by the supply opening 13 and dispensing opening 11. As such, a press of the finger on the upstream end of the pressing zone 8*a*, i.e. the zone in the vicinity of the supply opening 13, causes the closing of the input valve, then a translation of the press exerted on the pumping chamber 10 in the direction of the dispensing opening 11 causes the opening of the output valve and the emptying of the pumping chamber 10. Finally, it can be provided that the dispensing opening 11 be formed in the extension of the pressing zone 8*a* in such a way, in the continuity of the actuating gesture of the pumping chamber 10, as to collect the product on the finger.

In particular, this embodiment is favoured when the frame 9 has a guide track 22, in particular made as a hollow by having a width that is substantially equal to that of a finger, said track being arranged opposite the pressing zone 8*a*. Indeed, the seal of the pressing of the wall 8 on the track 22 is as such favoured in such a way as to facilitate the emptying of the pumping chamber 10 during the translation. Furthermore, in order to prevent a finger from pressing on the valves, the supply opening 13 and dispensing opening 11 are arranged outside of the track 22.

In the embodiment shown, the track 22 is defined by two protruding edges 22*a*, 22*b* in the pumping chamber 10 in such a way as to define the travel of the translation of the finger on the pressing zone 8*a*, with the supply opening 13 and dispensing opening 11 being adjacent respectively to one of said edges.

Figure 5A:
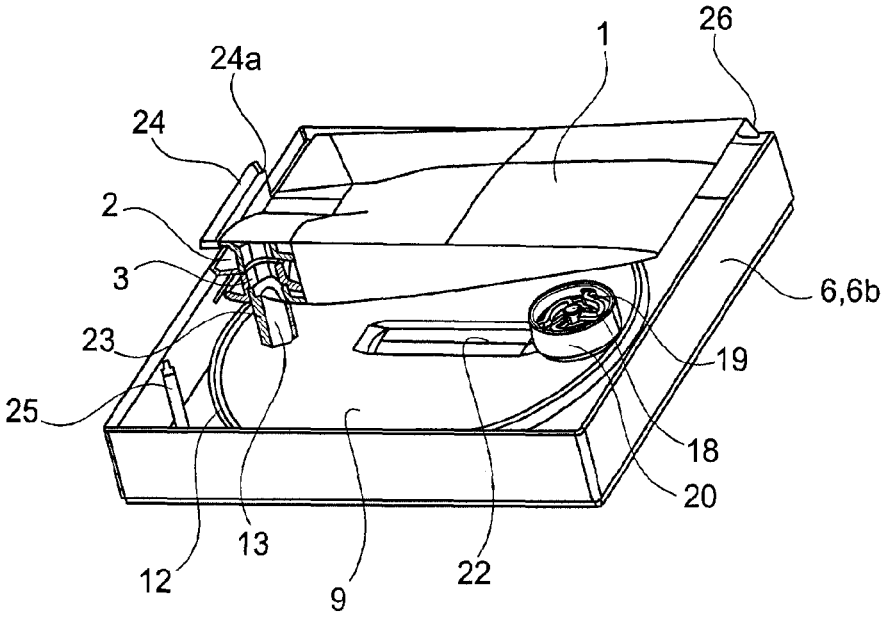
FIGS. 5*a*-5*b* show the mounting of a pouch (cut) on a cover during the assembly of a kit according to an embodiment of the invention, respectively at the beginning (FIG. 5*a*) and at the end (FIG. 5*b*) of the placement of the nipple in the well.
Figure 5B:
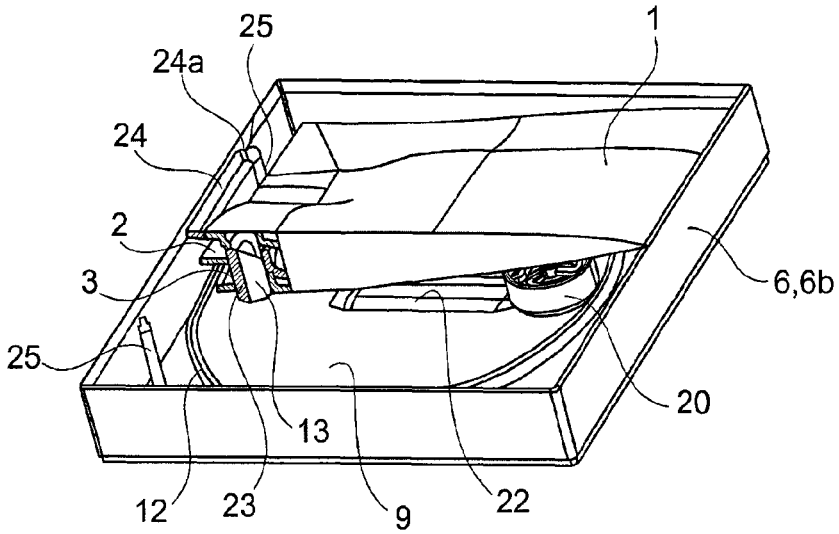

The frame 9 comprises, molded as a single part, a nipple 23 that is to be placed into the well 3 in order to place the supply opening 13 in sealed communication with the product conditioned in the pouch 1. In relation with FIG. 5, the coupling 2 has a surface 24 protruding from the casing of the pouch 1, the cover 6 comprising means for wedging said surface in order to provide the centering of the well 3 during the placement of the nipple 23. More precisely, the lower surface of the wall 6*a* of the cover 6 has two vertical rods 25 and the surface 24 has two trapezoidal lateral walls 24*a* which come to press slidingly on said rods in order to provide the centering. In addition, the protruding surface 24 constitutes a relief for grasping for the manipulation and the holding of the coupling 2 during the mounting of said coupling on the pouch.

In the embodiment shown, the nipple 23 has a bore forming the supply opening 13 of the pumping chamber 10, with the periphery of said nipple being sized to be press-fit into the well 3. Furthermore, the well 3 and/or the nipple 23 can include means of sealing the placement of said nipple into said well. In the figures, the well 3 is provided with a sealing bead 3*a* which comes to press against the periphery of the nipple 23.

The nipple 23 is set up so as to enable the perforation of the casing of the pouch 1 during the placement thereof into the well 3. In particular, the nipple 23 can have a chisel tip 23*a* enabling the perforation of the casing. According to the embodiment shown, the chisel tip 23*a* can be arranged so that the perforated washer is not detached from the rest of the casing in order to prevent obstruction of the well 3 and in order to arrange said washer at the interface between the nipple 23 and the well 3 in such a way as to improve the seal of the placement.

As such, the hermetically-sealed pouch 1 can be arranged in the cover 6 with the well 3 opposite the nipple 23 and, during the arranging of the pouch 1 in said cover, the nipple 23 perforates the casing (FIG. 5*a*) then said nipple is driven into the well 3 (FIG. 5*b*) in order to place the supply opening 13 in sealed communication with the product conditioned in said pouch.

Then, the cover 6 and the pouch 1 can be mounted onto the base 7 with said pouch housed in the space defined between them, in such a way as to assemble the dispensing system without requiring prior opening of the pouch 1. In relation with FIG. 5, the pouch 1 can have a folded edge 26, for example obtained via welding the flexible casing, in such a way as to increase the conditioning capacity of said pouch in the case.

What it is claimed is:

1. A dispensing kit for dispensing a product, said dispensing kit comprising:

a pouch having a flexible casing wherein said product is sealably conditioned, a dispensing case having a cover that is adapted to mount onto a base, said cover and said base defining therebetween a space for said pouch to be housed, said cover having an upper recess and a flexibly deformable wall mounted onto said upper recess, said wall having a dispensing opening for said product, a pumping chamber defined by said wall and a lower frame of said cover, said chamber being in communication with said dispensing opening, said frame having a supply opening for said product of said pumping chamber, said dispensing opening and supply opening having respectively an output valve and an input valve, said output valve and input valve are adapted to provide, via deformation of the pumping chamber, the dispensing of said product from said dispensing opening and, via elastic return, the supply of said chamber by said supply opening, a coupling incorporated into said pouch, said coupling having a well in communication with said conditioned product, said well being sealably covered by said casing of said pouch, and a nipple attached to said frame, said nipple being adapted to be placed in said well in order to dispose said supply opening in sealed communication with said conditioned product, and said nipple being adapted to perforate said casing when said nipple is placed within said well.

2. The dispensing kit according to claim 1, characterised in that the nipple has a bore forming the supply opening of the pumping chamber.

3. The dispensing kit according to claim 1, characterised in that the nipple has a chisel tip adapted to perforate said casing when the nipple is placed within said well.

4. The dispensing kit according to claim 1, characterised in that at least one of said well and said nipple includes means for sealing the placement of said nipple into said well.

5. The dispensing kit according to claim 1, characterised in that the frame releasably connects with a lower surface of the cover.

6. The dispensing kit according to claim 1, characterised in that the flexibly deformable wall is disposed over an upper surface of the cover.

7. The dispensing kit according to claim 6, characterised in that the flexibly deformable wall has a pressing zone for pressing on the pumping chamber.

8. The dispensing kit according to claim 7, characterised in that the flexibly deformable wall has a bead protruding from the upper surface of the cover, with the pressing zone being formed on said bead and the pumping chamber being formed inside said bead.

9. The dispensing kit according to claim 7, characterised in that the pressing zone has an extended geometry which is bordered on either side by the supply opening and dispensing opening in such a way as to provide for a translation of the pressing exerted on the pumping chamber from a vicinity of the supply opening in a direction of the dispensing opening.

10. The dispensing kit according to claim 9, characterised in that the dispensing opening is formed in the extended geometry of the pressing zone.

11. The dispensing kit according to claim 7, characterised in that the frame has a guiding track which is arranged opposite the pressing zone, with the supply opening and dispensing opening being arranged outside of said track.

12. The dispensing kit according to claim 11, characterised in that the track has two protruding edges in the pumping chamber, the supply opening and dispensing opening being adjacent respectively to one of said edges.

13. The dispensing kit according to claim 1, characterised in that the input valve is formed of a flexible lip, said flexible lip is adapted to be thrust onto the supply opening during the deformation of the pumping chamber.

14. The dispensing kit according to claim 1, characterised in that the output valve comprises a needle for closing off the dispensing opening, said needle is adapted to be displaced reversibly during the deformation of the pumping chamber.

15. The dispensing kit according to claim 14, characterised in that the frame has a seat wherein the needle is mounted in sealed translation by an intermediary of a means of elastic return, said needle comprising a collar in communication with the pumping chamber such that the pressure exerted on the product during the deformation of said chamber induces displacement of said needle outside of the dispensing opening.

16. The dispensing kit according to claim 1, characterised in that the coupling has a surface protruding from the casing of the pouch, with the cover comprising means for wedging said surface to align said well during the placement of the nipple.

17. The dispensing kit according to claim 1, characterised in that the pouch has a mouth wherein the coupling is fixed by covering the well with an edge of said mouth.

18. A dispensing system obtained by the assembly of a kit, said kit comprising:

a pouch having a flexible casing wherein said product is sealably conditioned, a dispensing case having a cover that is adapted to mount onto a base, said cover and said base defining therebetween a space for said pouch to be housed, said cover having an upper recess and a flexibly deformable wall mounted onto said upper recess, said wall having a dispensing opening for said product, a pumping chamber defined by said wall and a lower frame of said cover, said chamber being in communication with said dispensing opening, said frame having a supply opening for said product of said pumping chamber, said dispensing opening and supply opening having respectively an output valve and an input valve, said output valve and input valve are adapted to provide, via deformation of the pumping chamber, the dispensing of said product from said dispensing opening and, via elastic return, the supply of said chamber by said supply opening, a coupling incorporated into said pouch, said coupling having a well in communication with said conditioned product, said well being sealably covered by said casing of said pouch, and a nipple attached to said frame, said nipple being adapted to be placed in said well in order to dispose said supply opening in sealed communication with said conditioned product, and said nipple being adapted to perforate said casing when said nipple is placed within said well, wherein the cover is mounted onto the base with the pouch housed in the space defined by said cover and said base, and with the nipple being placed into the well in order to dispose the supply opening in sealed communication with the product conditioned in said pouch.

* * * * *